US011339623B2

(12) United States Patent
Dannish

(10) Patent No.: US 11,339,623 B2
(45) Date of Patent: May 24, 2022

(54) PROTECTION SLEEVE FOR TUBING HANGER THREADS

(71) Applicant: EMKADE DISTRIBUTION INC., Edmonton (CA)

(72) Inventor: Chad M. Dannish, Edmonton (CA)

(73) Assignee: Emkade Distribution Inc., Edmonton (CA)

( * ) Notice: Subject to any disclaimer, the term of this patent is extended or adjusted under 35 U.S.C. 154(b) by 0 days.

(21) Appl. No.: 16/741,636

(22) Filed: Jan. 13, 2020

(65) Prior Publication Data

US 2020/0224511 A1 Jul. 16, 2020

Related U.S. Application Data

(60) Provisional application No. 62/791,768, filed on Jan. 12, 2019.

(51) Int. Cl.
*E21B 33/04* (2006.01)
*E21B 43/26* (2006.01)

(52) U.S. Cl.
CPC ..... *E21B 33/04* (2013.01); *E21B 43/26* (2013.01)

(58) Field of Classification Search
CPC ..... E21B 17/1007; E21B 33/04
See application file for complete search history.

(56) References Cited

U.S. PATENT DOCUMENTS

| | | | | |
|---|---|---|---|---|
| 4,202,410 | A * | 5/1980 | Quebe | E21B 33/04 166/88.4 |
| 4,491,176 | A * | 1/1985 | Reed | E21B 33/0407 166/66.4 |
| 6,220,363 | B1 * | 4/2001 | Dallas | E21B 17/1007 166/382 |
| 6,367,551 | B1 * | 4/2002 | Fenton | E21B 33/038 166/345 |
| 7,607,485 | B2 * | 10/2009 | Fenton | E21B 33/035 166/368 |
| 8,631,873 | B2 * | 1/2014 | Sneed | E21B 23/01 166/348 |
| 9,206,663 | B2 * | 12/2015 | Smith | E21B 17/1007 |
| 10,385,628 | B2 * | 8/2019 | Colenutt | E21B 17/1085 |
| 2003/0141071 | A1 * | 7/2003 | Hosie | E21B 33/047 166/350 |
| 2005/0284640 | A1 * | 12/2005 | Borak, Jr. | E21B 33/047 166/369 |

* cited by examiner

*Primary Examiner* — Matthew R Buck
(74) *Attorney, Agent, or Firm* — Donald V. Tomkins

(57) ABSTRACT

A cylindrical protection sleeve is insertable into the bore of a tubing hanger in a wellhead, and has a skirt that projects into the bore of the tubing hanger to cover the lift thread formed in the upper region of the hanger bore, thus shielding the lift thread from contact by frac fluid and proppant particles flowing through the hanger bore and preventing resultant damage to the lift thread. Optionally, an annular deflection lip may be provided within the bore of the protection sleeve's skirt to deflect the downward flow of proppant particles toward the center of the flow path through the hanger, and thus minimizing contact of proppant particles with the back-pressure valve (BPV) thread profile formed in the hanger bore below the lift thread, and preventing or reducing resultant damage to the BPV thread profile.

9 Claims, 7 Drawing Sheets

PROTECTION SLEEVE FOR TUBING HANGER THREADS

FIELD OF THE DISCLOSURE

The present disclosure relates in general to devices and methods for protecting internal threads on a tubing hanger, and in particular to devices and methods for protecting against thread damage caused by fluids carrying abrasive materials flowing through the bore of the tubing hanger (for example, "washout" of hanger lift threads during well fraccing operations).

BACKGROUND

During a typical "fraccing" operation on an oil or gas well, frac fluid carrying a proppant (typically sand or ceramic particles) is pumped under pressure into a subsurface reservoir through the wellhead assembly and down the tubing or casing. Depending on the actual mixture of the proppant, the pumping duration, and the frac fluid flow velocity, mechanical surfaces can be eroded or "washed" by the proppant material. This can occur in all components of the top section of the wellhead, in the tubing/casing hanger, and in the tubing or casing.

Typically, the tubing/casing is suspended by a tubing hanger, which is landed in the tubing/casing spool of the wellhead assembly. A bonnet is attached to the upper flange of the spool to provide pressure containment. A frac tree assembly, which consists of a series of valves and crosses (as will be familiar to persons of ordinary skill in the art), is mounted to the upper connection of the bonnet.

The internal details of a typical tubing/casing hanger include a lift thread, a back-pressure valve ("BPV") thread profile, and a suspension thread. The BPV thread profile allows for a plug to be installed into the hanger profile to contain pressure from below or from above, or both. This feature also allows the upper section of the frac tree assembly to be pressure-tested after installation and before use. The suspension thread suspends the tubing or casing, and the lift thread is used to run or retrieve the hanger and tubing/casing string. The lift thread is typically an API tapered thread, but it can also be a special run/retrieval thread used in conjunction with a run/retrieval tool.

During the pumping and flow-back phases of a well frac, the frac fluid/proppant mixture must flow through each component of the wellhead equipment. The geometry of the transitions between the components will have an effect on the potential for the frac fluid to erode or "wash" physical features within each component.

The transition region between the tubing hanger and the bonnet is particularly susceptible to erosion from the flow of frac fluid, due to the significant changes of internal geometries that occur in this region. Such changes in geometry cause the flowing frac fluid/proppant mixture to be directed against the lift thread and the BPV thread profile, resulting in erosion ("washout") of the lift threads and the BPV thread profile. In the worst case, this erosion can damage the internal features of these components to the extent that they are no longer functional. In the case of the lift thread, erosion may cause there to be insufficient thread remaining to safely pick up and retrieve the hanger and tubing/casing string, in which case the tubing/casing would need to be "speared" in order to retrieve them from the well, and this is a costly operation requiring special tools. In the case of the BPV thread profile, erosion may resulting in there being insufficient thread remaining to safely set a pressure plug to provide pressure isolation.

During the flow-back phase of a well frac (i.e., when frac fluid is flowing out of the well), the bonnet can be damaged in the same way but in reverse.

For the foregoing reasons, there is a need for improved means for protecting tubing hanger threads and other internal features of wellhead assemblies from abrasion damage caused by the flow of frac fluid/proppant mixtures flowing into or out of a well. The present disclosure is directed to this need.

BRIEF SUMMARY

The present disclosure teaches embodiments of a protection sleeve that is insertable into a tubing hanger so as to physically protect or shield the lift thread of the hanger from direct contact with frac fluid and proppant flowing through the hanger bore, and to manage or modify fluid flow characteristics within the hanger bore so as to divert proppant particles in the frac fluid toward the center of the hanger bore and away from the BPV thread profile.

In general terms, the present disclosure teaches a generally cylindrical protection sleeve, typically made from a high-strength steel, that is insertable into the upper end of a tubing hanger mounted in the tubing spool of a wellhead, such that the bottom of the protection sleeve is landed or seated within the hanger, with a lower portion (or "skirt") of the protection sleeve covering all or substantially all of the lift thread of the hanger, and terminating above the BPV thread profile. An upper portion of the protection sleeve projects above the upper end of the hanger such that it will partially extend into a bonnet subsequently mounted to the tubing spool. The installation of the bonnet thus will "trap" the protection sleeve, centralized within the bore of the tubing hanger, such that the protection sleeve is prevented from moving during pumping or during downhole operations.

The bore of the protection sleeve preferably is substantially cylindrical throughout its length, with a diameter at least approximately equal to the diameter of the hanger bore, thus promoting fluid flow through the hanger and into the suspended tubing string that is less turbulent than would otherwise be expected to occur in conventional tubing hangers.

In preferred embodiments, an annular deflection lip projects radially inward from a lower region of the skirt of the protection sleeve. This deflection lip, which may be of any functionally effective geometric profile, has the effect of directing the downward flow of frac fluid—and in particular the abrasive proppant particles carried therein—away from the cylindrical bore surfaces of the protection sleeve and the tubing hanger and more toward the center of the fluid flow path through the hanger bore, and thereby reducing the potential for abrasive contact between the proppant particles and the BPV thread profile that is exposed below the protection sleeve skirt. The effectiveness of the deflection lip in diverting proppant particles toward the center of the fluid flow path predictably will tend to be greatest in the immediate vicinity of the deflection lip, it may be preferable or desirable for the deflection lip to be formed at or close to the bottom of the skirt, and for the skirt to extend into the tubing hanger as close as possible to the BPV thread profile, in order to optimize the effectiveness of the deflection lip in preventing or minimizing proppant contact with the BPV thread profile.

In summary, embodiments of protection sleeves in accordance with the present disclosure may provide beneficial features and operational characteristics including the following:

- Creation of a smoother flow path, minimizing geometric changes to the bores between the bonnet and the hanger;
- Creation of a physical mechanical barrier between the lift thread and the frac fluid/proppant flow;
- An annular deflection lip formed in a lower region of the sleeve bore evenly directs solids (e.g., proppant particles) in the fluid stream toward the center of the flow stream and away from the BPV thread profile; and
- The protection sleeve is configured to maintain full-bore access to allow installation and removal of the back-pressure valve and full-bore access to the tubing/casing string.

Optionally, a protection sleeve in accordance in the present disclosure may be configured or adapted to provide a pressure seal between the hanger and the bonnet. However, this is by way of non-limiting example only, as this feature is not essential for the protection sleeve to provide the primary thread-protection functions as described, provided that the sleeve is centralized in the tubing hanger bore and is reasonably stable in the fluid flow.

BRIEF DESCRIPTION OF THE DRAWINGS

Embodiments will now be described with reference to the accompanying figures, in which numerical references denote like parts, and in which.

DETAILED DESCRIPTION

Figure 1:
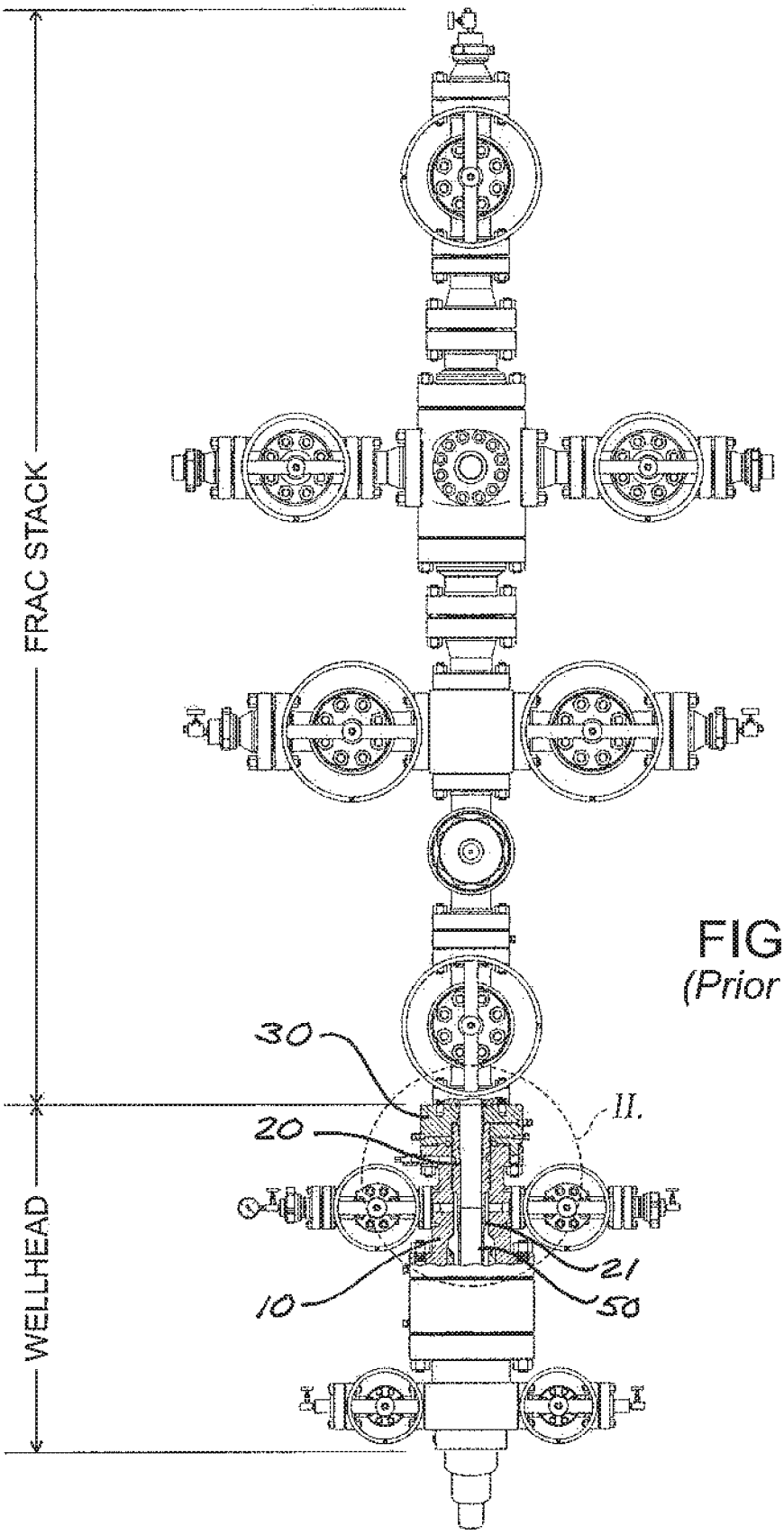
FIG. 1 (Prior Art)
FIG. 1 is a partially-sectioned elevation view of an exemplary prior art wellhead and frac stack arrangement.

FIG. 1 illustrates an exemplary prior art wellhead and frac stack assembly, with the wellhead incorporating a tubing spool 10 carrying a tubing hanger 20, with a bonnet 30 mounted over tubing spool 10, and shown with a tubing string 50 suspended from the lower end of the bore of hanger 20. In this exemplary assembly, the lower portion of tubing hanger 20 carrying the suspension thread has a smaller diameter than the upper portion of hanger 20, and is commonly referred to as a "tong neck". However, this is by way of example only, as not all tubing hangers have a tong neck.

Figure 2:
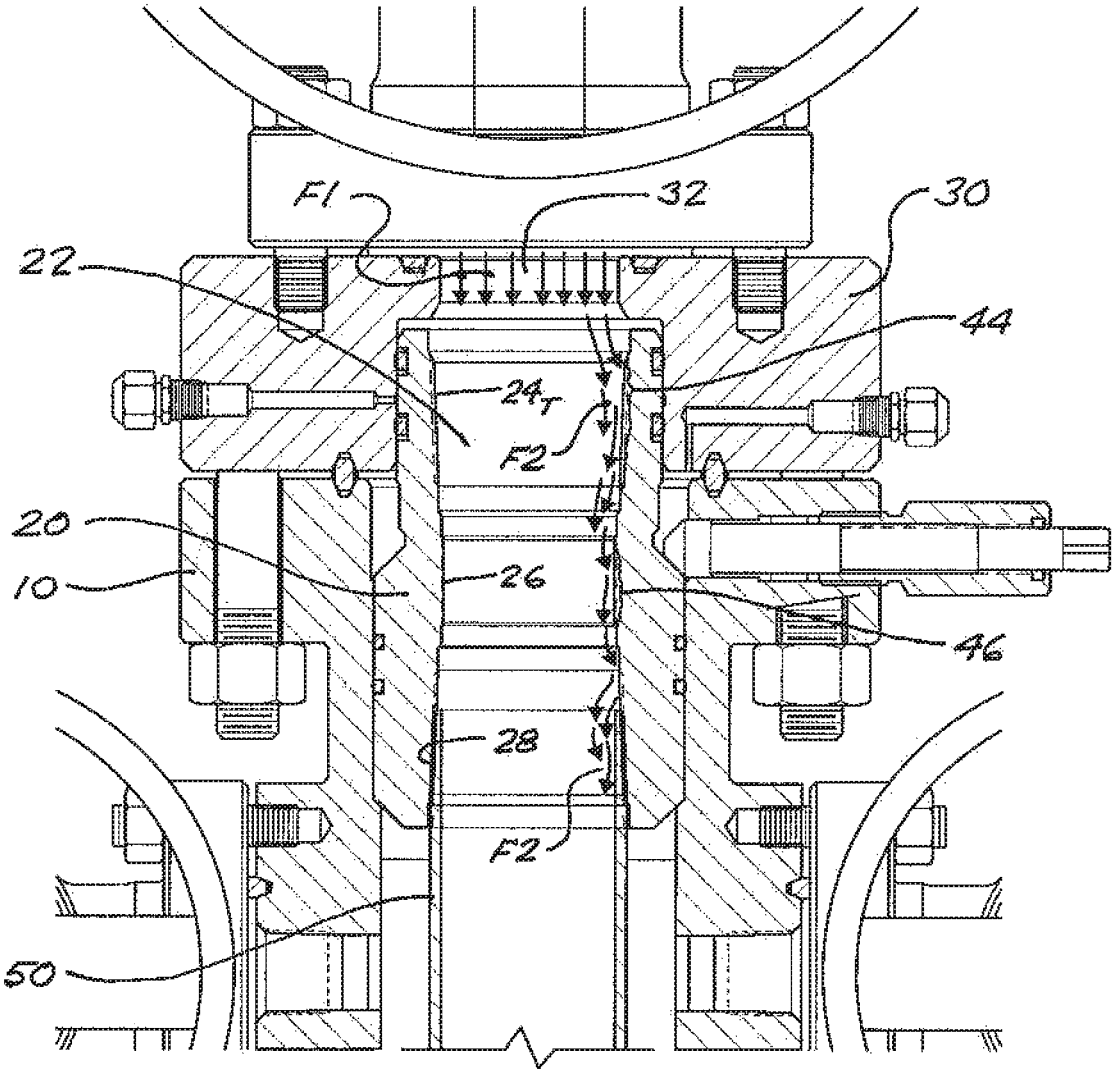
FIG. 2 (Prior Art)
FIG. 2 is an enlarged sectional detail of the tubing spool, tubing hanger, and bonnet of the prior art wellhead illustrated in FIG. 1, with flow lines schematically indicating downward flow of a frac fluid/proppant mixture through the bore of the hanger, causing erosion ("washout") of the lift thread and the back-pressure valve (BPV) thread profile formed in the tubing hanger bore.

FIG. 2 is an enlarged detail of a prior art tubing hanger 20 prior art generally as shown in FIG. 1 (but without a tong neck), having a hanger bore 22 with a tapered lift thread 24T formed in an upper region of hanger bore 22, a back-pressure valve (BPV) thread profile 26 formed in a medial region of bore 22, and a suspension thread 28 formed in a lower region of bore 22. (As previously noted herein, the lift thread could alternatively be a non-tapered thread, and in such cases will be referred to herein as simply lift thread 24.) Flow arrows F1 conceptually denote downward flow of a frac fluid/proppant mixture through a primary bore 32 of bonnet 30 into hanger bore 22. Flow arrows F2 conceptually denote downward fluid flow paths immediately adjacent to the hanger bore surfaces, with reference numbers 44 and 46 respectively denoting where erosion ("washout") of lift thread 24T and BPV thread profile 26 can occur due to the impact of proppant particles in the flowing fluid mixture.

Figure 3:
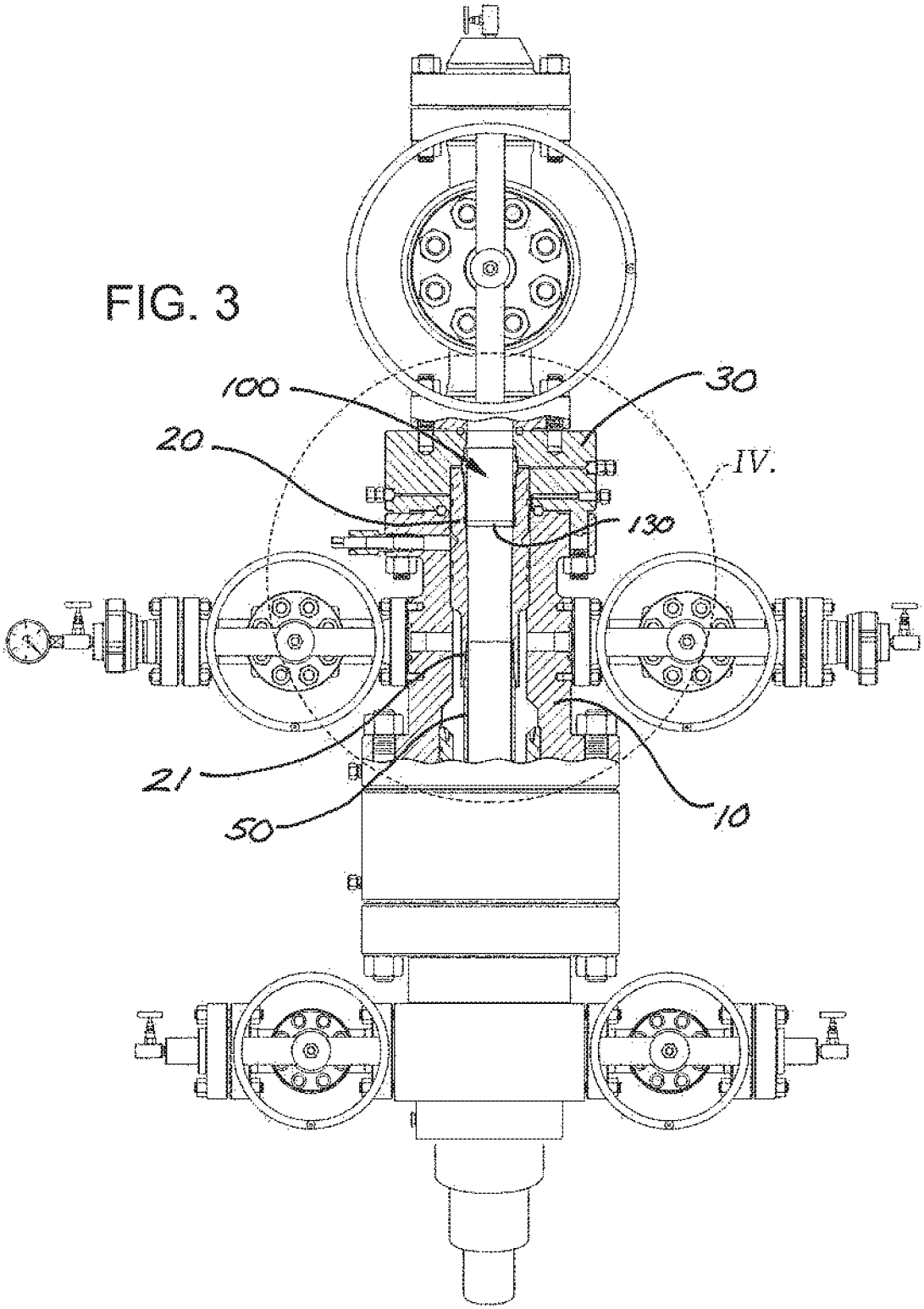
FIG. 3 is an enlarged partially-sectioned elevation of a wellhead/frac stack arrangement in which an embodiment of a protection sleeve in accordance the present disclosure is positioned in the tubing hanger bore to shield the lift thread in the hanger bore from the flow of frac fluid/proppant mixture through the hanger bore.
Figure 4:
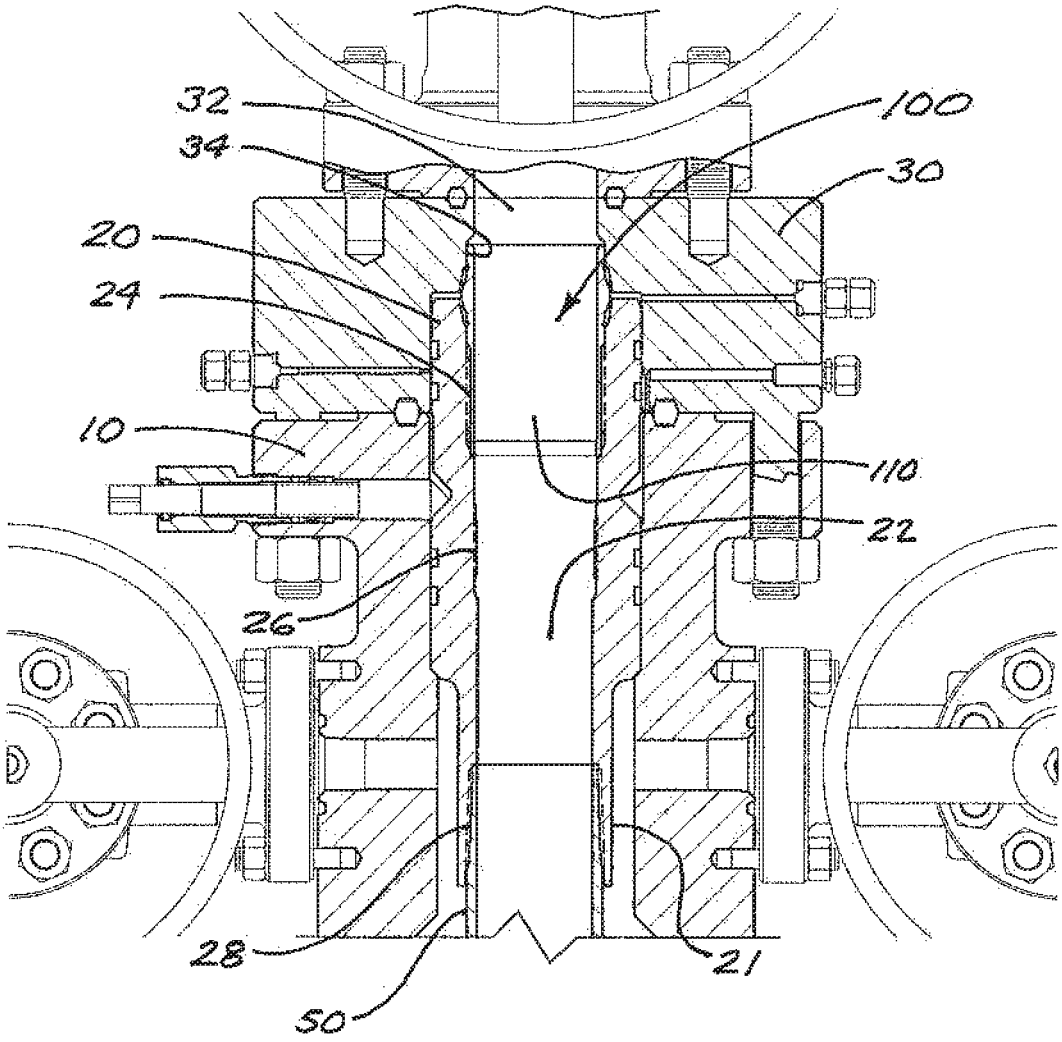
FIG. 4 is an enlarged section though the tubing hanger and protection sleeve in FIG. 3.
Figure 5:
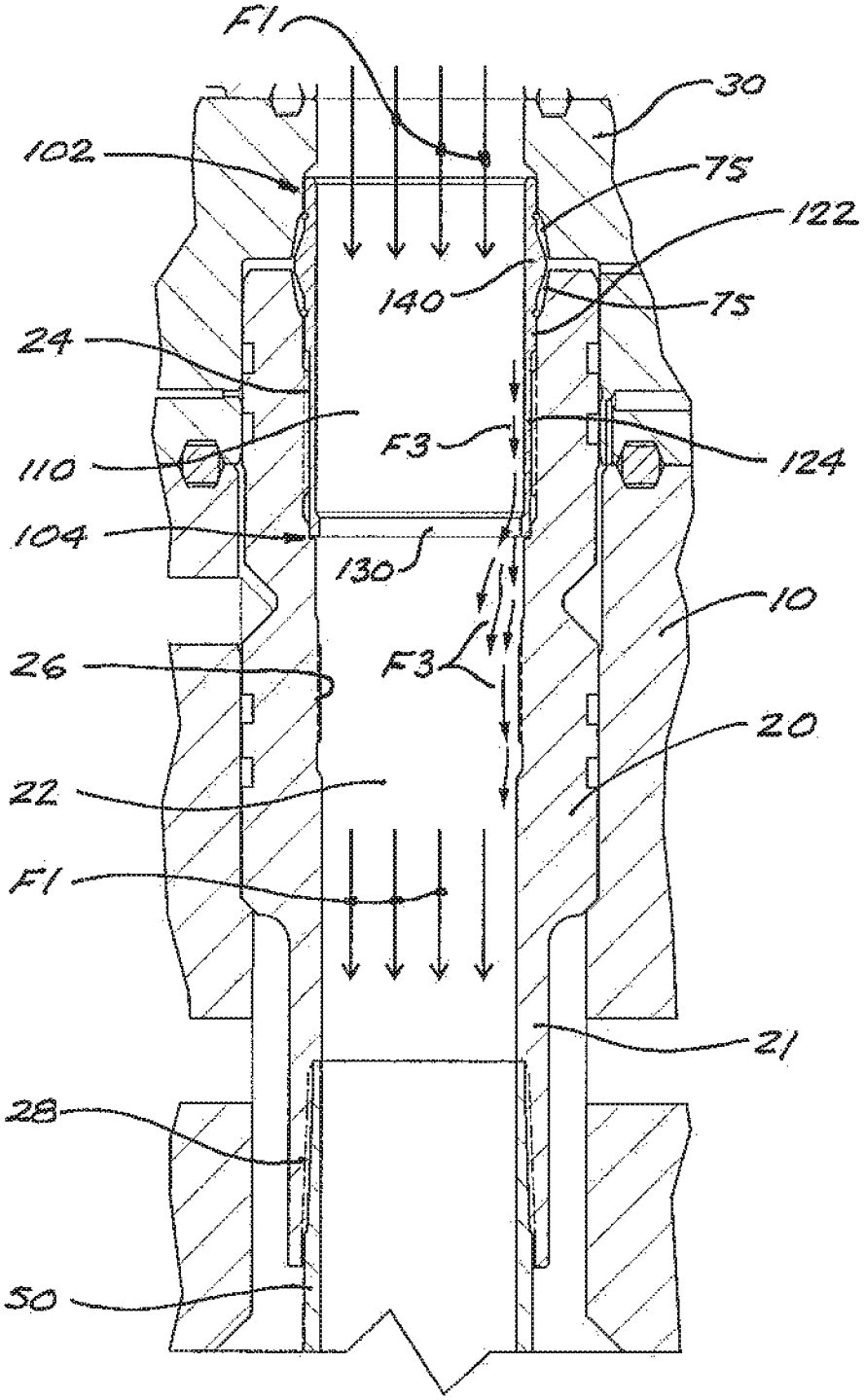
FIG. 5 is a further-enlarged section though the tubing hanger and protection sleeve in FIG. 4, showing an annular flow deflection lip formed at the lower end of the protection sleeve bore, and with flow lines schematically illustrating comparatively smoother fluid flow through the cylindrical sleeve bore, and redirection of proppant particles suspended in the frac fluid radially inward away from the sleeve/hanger bore as the frac fluid/proppant mixture flows downward over the flow deflection lip.

FIGS. 3, 4, and 5 illustrate a wellhead having a tong-necked tubing hanger 20 and with a (non-tapered) lift thread 24, with a first embodiment 100 of a protection sleeve in accordance with the present disclosure coaxially disposed and retained within an upper region of hanger bore 22, and projecting partially above tubing hanger 20 and into a secondary bore 34 of bonnet 30. In the particular embodiment illustrated in FIGS. 3, 4, and 5, the bores of hanger 20 and bonnet 30 are configured to receive protection sleeve 100 such that the fluid flow path defined by bonnet bore 32, protection sleeve bore 110, hanger bore 22, and the bore of suspended tubing string 50 will have a substantially uniform cross-sectional area in order to promote smooth fluid flow through the wellhead and into tubing string 50.

As most clearly seen in FIG. 5, protection sleeve 100 has an upper end 102 and a lower end 104, and can be considered as comprising an upper portion 122 and a lower portion (or "skirt") 124. When sleeve 100 is installed in hanger bore 22 as shown in FIG. 5, the outer surface of skirt 124 lies closely adjacent to and completely covers lift thread 24 in hanger bore 22 and protects it from direct contact with flowing frac fluid. As shown, lower end 104 of protection sleeve 100 lies above BPV thread 26 in hanger bore 22.

Optionally, an inwardly-projecting annular deflection profile (or "deflection lip") 130 may be formed in protection sleeve bore 110 at or closely adjacent to lower end 104 of sleeve 100. As conceptually denoted by flow arrows F3 in FIG. 5, deflection lip 130 will have the effect of deflecting proppant particles suspended in the flowing frac fluid away from the surfaces of sleeve bore 110 and toward the middle of the fluid flow path. This has the beneficial effect of reducing or preventing the undesirable impact of flowing proppant particles against BPV thread profile 26 along at least a portion of its axial length.

The radial thickness of deflection lip 130 will typically be a matter of design choice depending on various factors specific to the particular installation and operational environment in question. In general terms, the effectiveness of deflection lip 130 for the above-noted purpose will be a function of the selected lip geometry, the geometry of the sleeve bore 110 in which it is formed, and the velocity and other characteristics of the fluid flow through sleeve bore 110. For example, the effectiveness of a deflection lip 130 of a given geometry will tend to be greater as fluid flow velocity increases.

Figures 6A, 6B, 6C:
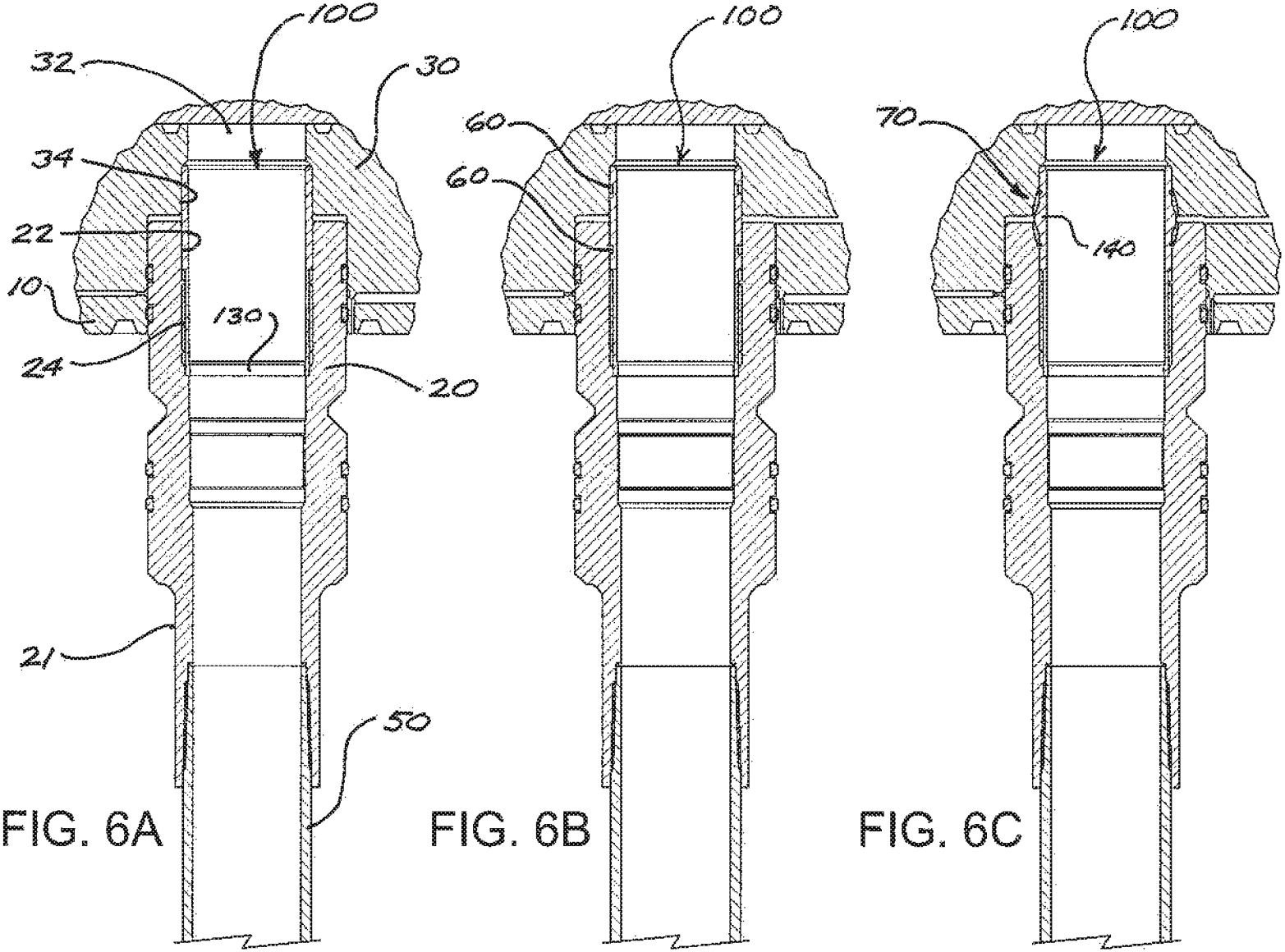
FIGS. 6A, 6B, and 6C are cross-sections through alternative installations of a protection sleeve positioned in the bore of tubing hanger in which the lift thread is a non-tapering ACME thread (as in FIGS. 4 and 5), with no seals provided between the sleeve and the hanger bore or the bonnet bore (per FIG. 6A), with soft seals (e.g., O-rings) provided between the sleeve and both the hanger bore and the bonnet bore (per FIG. 6B), and with metal seals provided between the sleeve and both the hanger bore and the bonnet bore (per FIG. 6C)
Figures 7A, 7B, 7C:
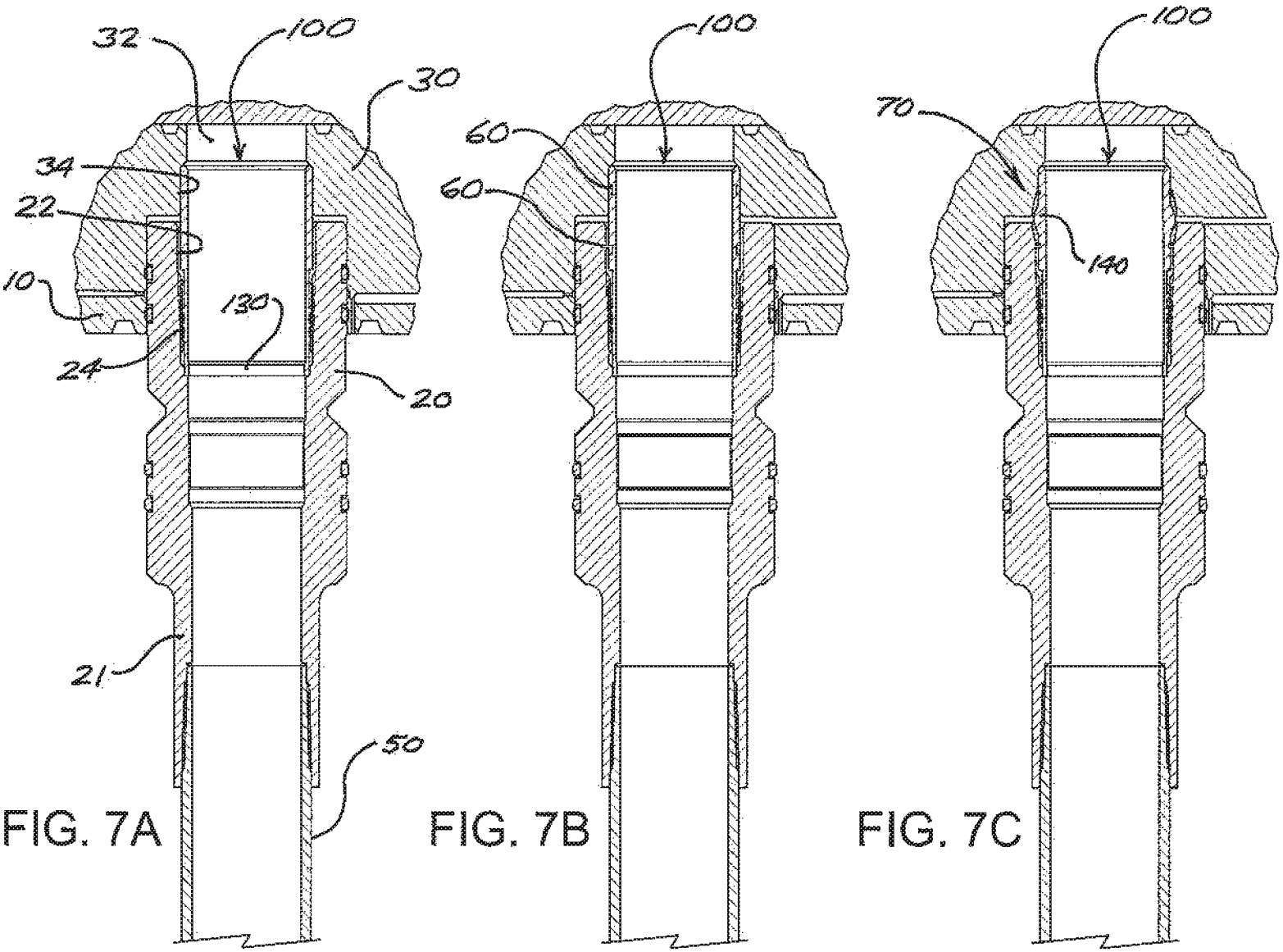
FIGS. 7A, 7B, and 7C are cross-sections through alternative installations generally as in FIGS. 6A, 6B, and 6C, respectively, except that the lift thread in the tubing hanger bore is a typical API tapered thread.

FIGS. 6A-6C and FIGS. 7A-7C illustrate various alternative configurations and installations of protection sleeves in accordance with the present disclosure. In the installations shown in FIGS. 6A-6C, tubing hanger bore 22 carries a straight (i.e., non-tapering) lift thread 24, whereas in FIGS. 7A-7C, tubing hanger bore 22 carries a tapered lift thread 24T. In FIGS. 6A and 7A, no seals are provided between protection sleeve 100 and hanger bore 22, or between sleeve 100 and secondary bore 34 of bonnet 30. In FIGS. 6B and 7B, soft seals 60 (e.g. O-rings) are provided between protection sleeve 100 and hanger bore 22, and between sleeve 100 and secondary bore 34 of bonnet 30. In FIGS. 6C and 7C, sealing between protection sleeve 100 and hanger bore 22 and between sleeve 100 and secondary bore 34 of bonnet 30 is effected by a metal seal 70.

Metal seal 70 is also provided in the embodiment shown in FIGS. 3-5, in which upper portion 122 of sleeve 100 is formed with an external annular seal profile 140 configured to form annular spaces 75 between sleeve 100 and both hanger 20 and bonnet 30 to receive metal seal elements (not shown) which will be compressed into sealing contact with seal surfaces on sleeve 100, hanger 20, and bonnet 30 as the bolts anchoring bonnet 30 to tubing spool 10 are torqued up. Typically, the metal seal elements will be made of a softer metal than the components being sealed, so that the desired metal-to-metal seal will be effected by deformation of the seal elements only.

In variant embodiments, an auxiliary sleeve (not illustrated) may be inserted into sleeve bore 110 so as to extend below lower end 104 of a protection sleeve 100 and thus shield BPV thread profile 26 from contact with the flow of a frac fluid/proppant mixture. In such installations, protection sleeve 100 typically would not be provided with a deflection lip 130. Tubing hanger bore 22 would be modified as might be necessary to accommodate the auxiliary sleeve. The auxiliary sleeve could be retained in position relative to sleeve 100 by any functionally effective means, such as but not limited to a threaded connection with sleeve bore 110 or by threaded engagement with BPV thread profile 26. The auxiliary sleeve would be withdrawn from sleeve bore 110 when it is desired to install a back-pressure valve.

Controlling the geometry of the bore is important for both pumping and flow-back conditions. By eliminating dramatic changes in bore geometry, fluid flow through a tubing hanger fitted with a protection sleeve in accordance with the present disclosure is less turbulent than it would be without the protection sleeve, resulting in lower fluid flow velocities along the surfaces of the bore (thus reducing erosion severity), and the velocities of the solids carried by the flowing fluid are more aligned with the bulk direction of flow toward the center of the bore, which further reduces erosion severity, because it is the velocity and the attack angle of the solids relative to the bore surface that determine potential susceptibility to wash/erosion and the severity of such wash/erosion.

By creating a physical barrier between the lift threads and the fluid flow, the protection sleeve completely eliminates the risk of wash/erosion to the lift threads. The protection sleeve is preferably made from a hard and tough steel having high resistance to abrasion. In cases where the protection sleeve is not intended to create a pressure seal between the hanger and bonnet, the protection sleeve can be designed for wear resistance only, thus minimizing wall thicknesses required for the sleeve. This in combination with the conditioning of the upstream fluid flow further reduces wash/erosion to the protection sleeve.

The provision of an annular lip or deflection element near the end of the bore of the protection sleeve redirects solids in the flowing frac fluid away from the bore surface and toward the center of the flow stream through the bore. This redirection of the solids reduces the wash/erosion of the BPV thread profile, which is exposed to the fluid flow.

Protection sleeve designs in accordance with the present disclosure can be readily modified and configured to provide corrosion protection for the lift thread by adding seals to the bottom of the sleeve, behind the deflection element, so as to isolate the lift threads from corrosive injection fluids or production fluids. Such alternative embodiments of the protection sleeve may be of particular value for purposes of long-term completion systems.

If the carrier portion of the sleeve uses elastomer seals that seal in the hanger and bonnet profiles for pressure containment, the lower seals would need to be uni-directional seals; otherwise, a venting system would be required to allow trapped pressure from behind the sleeve be relieved during installation. A metal-to-metal carrier configuration most likely would not require such venting, because the installation stroke of the metal system is relatively short.

It will be readily appreciated by persons skilled in the art that various modifications to embodiments in accordance with the present disclosure may be devised without departing from the present teachings, including modifications which may use structures or materials later conceived or developed. It is to be especially understood that the scope of the present disclosure is not intended to be limited by or to any particular embodiments described, illustrated, and/or claimed herein, but should be given the broadest interpretation consistent with the disclosure as a whole. It is also to be understood that the substitution of a variant of a claimed element or feature, without any substantial resultant change in functionality, will not constitute a departure from the scope of the disclosure or claims.

In this patent document, any form of the word "comprise" is intended to be understood in a non-limiting sense, meaning that any element or feature following such word is included, but elements or features not specifically mentioned are not excluded. A reference to an element or feature by the indefinite article "a" does not exclude the possibility that more than one such element or feature is present, unless the context clearly requires that there be one and only one such element or feature.

Any use of any form of any term describing an interaction between elements or features (such as but not limited to "connect", "engage", "couple", and "attach") is not intended to limit such interaction to direct interaction between the elements or features in question, but may also extend to indirect interaction between the elements and features in question, such as through secondary or intermediary structure.

Relational terms such as but not limited to "vertical", "horizontal", "perpendicular", "parallel", "coaxial", and "coincident" are not intended to denote or require absolute mathematical or geometrical precision. Accordingly, such terms are to be understood as denoting or requiring substantial precision only (e.g., "substantially horizontal" or "generally parallel") unless the context clearly requires otherwise.

Any use of any form of the term "typical" is to be interpreted in the sense of being representative of common usage or practice, and is not to be interpreted as implying essentiality or invariability.

What is claimed is:

1. A protection sleeve for installation in a bore of a tubing hanger, said protection sleeve having an upper end, a lower end, a generally cylindrical outer surface, and a sleeve bore extending between said upper and lower ends, wherein a lower portion of the protection sleeve has an outer diameter sized to fit within and closely adjacent to a lift thread profile formed in the bore of the tubing hanger so as to cover at least a portion of the lift thread profile without threaded engagement with the lift thread profile, and without sealing against the bore of the tubing hanger below the lift thread profile.

2. A protection sleeve as in claim 1, further comprising a continuous annular deflection profile projecting radially inward from a surface of the sleeve bore at or near the lower end of the protection sleeve, said annular deflection profile being configured to deflect proppant particles suspended in a downward flow of frac fluid through the bore of the protection sleeve toward the center of the fluid flow path.

3. A protection sleeve as in claim 1, wherein an upper region of the protection sleeve is adapted to carry one or more resilient annular seal elements to provide a seal between the protection sleeve and the bore of the tubing hanger at a point above the lift thread profile, and a seal between the protection sleeve and a bore of a bonnet mounted over the protection sleeve and the tubing hanger.

4. A protection sleeve as in claim 1, further comprising an annular seal profile projecting from the cylindrical outer surface of the protection sleeve in an upper region of the protection sleeve, said annular seal profile being configured to provide a metal-to-metal seal between the annular seal profile and a seal surface on the tubing hanger at a point above the lift thread profile, and between the annular seal profile and a seal surface on a bonnet mounted over the protection sleeve and the tubing hanger, in conjunction with corresponding annular metal seal elements.

5. A wellhead assembly comprising a tubing spool, a tubing hanger having a hanger bore, a bonnet, and a protection sleeve coaxially positioned in the hanger bore, wherein:

(a) a lift thread profile is formed in an upper region of the hanger bore;

(b) a back-pressure valve (BPV) thread profile is formed in a medial region of the hanger bore;

(c) a suspension thread is formed in a lower region of the hanger bore;

(d) the protection sleeve has an upper end, a lower end, a generally cylindrical outer surface, and a sleeve bore extending between said upper and lower ends, wherein a lower portion of the protection sleeve is configured to fit within the lift thread profile and to shield at least a portion of the length of the lift thread profile, without threaded engagement with the lift thread profile, and without sealing against the bore of the tubing hanger below the lift thread profile;

(e) an upper portion of the protection sleeve extends above the top of the tubing hanger; and (f) the bonnet is removably mountable to the tubing spool so as to retain the protection sleeve between the bonnet and the tubing hanger, with the upper end of the protection sleeve extending into a bore of the bonnet.

6. A wellhead assembly as in claim 5, wherein the protection sleeve further comprises a continuous annular deflection profile projecting radially inward from a surface of the sleeve bore at or near the lower end of the protection sleeve, said annular deflection profile being configured to deflect proppant particles suspended in a downward flow of frac fluid through the bore of the protection sleeve toward the center of the fluid flow path.

7. A wellhead assembly as in claim 5, wherein the protection sleeve carries one or more resilient annular seal elements to provide a seal between the protection sleeve and the bore of the tubing hanger at a point above the lift thread profile, and a seal between the protection sleeve and the bore of the bonnet when the bonnet is mounted over the protection sleeve and the tubing hanger.

8. A wellhead assembly as in claim 5, wherein the protection sleeve further comprises an annular seal profile projecting from the cylindrical outer surface of the protection sleeve, said annular seal profile being configured to provide a metal-to-metal seal between the annular seal profile and a seal surface on the tubing hanger at a point above the lift thread profile, and between the annular seal profile and a seal surface on the bonnet, in conjunction with corresponding annular metal seal elements.

9. A wellhead assembly as in claim 5, further comprising an auxiliary sleeve disposed within and extending through the sleeve bore so as to cover the back-pressure valve thread profile formed in the hanger bore below the lift thread profile.

* * * * *